US011253788B2

(12) United States Patent
Manovi et al.

(10) Patent No.: US 11,253,788 B2
(45) Date of Patent: Feb. 22, 2022

(54) TOY SPINNING TOP AND TOY SYSTEM WITH A TOY SPINNING TOP AND A TOY FIGURINE

(71) Applicant: LEGO A/S, Billund (DK)

(72) Inventors: Cerim Manovi, Billund (DK); Aske Klejnstrup Garling, Billund (DK); Leonardo Francisco Lopez, Billund (DK); Jaime Sanchez Potter, Billund (DK)

(73) Assignee: LEGO A/S, Billund (DK)

( * ) Notice: Subject to any disclaimer, the term of this patent is extended or adjusted under 35 U.S.C. 154(b) by 0 days.

(21) Appl. No.: 17/048,542

(22) PCT Filed: Apr. 26, 2019

(86) PCT No.: PCT/EP2019/060797
§ 371 (c)(1),
(2) Date: Oct. 16, 2020

(87) PCT Pub. No.: WO2019/207133
PCT Pub. Date: Oct. 31, 2019

(65) Prior Publication Data

US 2021/0093979 A1 Apr. 1, 2021

(30) Foreign Application Priority Data

Apr. 26, 2018 (DK) ..... PA201870245

(51) Int. Cl.
*A63H 1/00* (2019.01)
*A63H 1/20* (2006.01)
*A63H 33/08* (2006.01)

(52) U.S. Cl.
CPC ..... *A63H 1/20* (2013.01); *A63H 33/086* (2013.01)

(58) Field of Classification Search
CPC ..... A63H 1/20; A63H 33/086; A63H 1/00
(Continued)

(56) References Cited

U.S. PATENT DOCUMENTS 968,057 A * 8/1910 Iwata ..... A63H 37/00 472/54
1,089,668 A * 3/1914 Prendergast ..... A63H 3/52 446/69

(Continued)

FOREIGN PATENT DOCUMENTS

CN 2307611 Y 2/1999
CN 202715237 U 2/2013

(Continued)

OTHER PUBLICATIONS

Danish Search Report and Search Opinion issued in priority application No. PA 2018 70245, dated Nov. 2, 2018. (8 pages).

(Continued)

*Primary Examiner* — Eugene L Kim
*Assistant Examiner* — Matthew B Stanczak
(74) *Attorney, Agent, or Firm* — Day Pitney LLP; Valeriya Svystun

(57) ABSTRACT

The invention concerns a toy system comprising a toy figurine and a spinner body, the spinner body having an elongate axis; a sidewall; and a bottom wall, wherein said sidewall of the spinner body comprises a top rim; an outside surface; and an inside surface, wherein said bottom wall comprises an outside bottom surface; and an inside bottom surface, wherein the inner bottom surface comprises first connection means for releasably connecting second connection means of said toy figurine to the toy spinning top, wherein said sidewall has a height from said inner bottom surface of said top rim, and wherein the height from said inner bottom surface to said top rim is equal a height of the (Continued)

toy figurine from second connection means formed at one end of legs to a shoulder portion of a body formed between the legs and a head resting on said shoulder portion.

11 Claims, 13 Drawing Sheets

(58) Field of Classification Search
USPC ..... D21/455–465; 446/256–264
See application file for complete search history.

(56) References Cited

U.S. PATENT DOCUMENTS

| | | | | | |
|---|---|---|---|---|---|
| 1,115,863 | A | * | 11/1914 | Preyer | A63H 1/02 446/260 |
| 1,278,208 | A | * | 9/1918 | Pruitt | A63H 1/00 446/256 |
| 1,281,866 | A | | 10/1918 | Stahl | |
| D68,257 | S | * | 9/1925 | Jampel | D21/460 |
| D68,259 | S | * | 9/1925 | Jampel | D21/460 |
| D167,592 | S | * | 8/1952 | Schwartz | D9/600 |
| 2,676,432 | A | * | 4/1954 | Field | A63H 1/30 446/251 |
| 3,520,078 | A | * | 7/1970 | Klamer | A63H 3/16 446/73 |
| D237,521 | S | * | 11/1975 | Tremblay | D21/460 |
| 4,211,030 | A | * | 7/1980 | Morrison | A63H 1/06 446/231 |
| D262,610 | S | * | 1/1982 | Westlake | D10/111 |
| D269,665 | S | * | 7/1983 | Lehr | 415/909 |
| 4,636,177 | A | | 1/1987 | Koguchi | |
| 4,964,831 | A | * | 10/1990 | Wolff | A63H 3/50 428/542.4 |
| D316,122 | S | * | 4/1991 | Watford | D21/460 |
| 5,026,057 | A | * | 6/1991 | Watford | A63H 13/06 273/108.1 |
| 5,122,089 | A | * | 6/1992 | Haran | A63H 1/18 446/257 |
| 5,224,894 | A | * | 7/1993 | Nelson | A63H 33/004 428/17 |
| D347,461 | S | * | 5/1994 | Bertrand | D21/451 |
| 5,645,463 | A | * | 7/1997 | Olsen | A63H 33/04 446/104 |
| D404,437 | S | * | 1/1999 | Lam | D21/460 |
| D410,505 | S | * | 6/1999 | Toft | D21/502 |
| D423,602 | S | * | 4/2000 | Yamazaki | D21/398 |
| D428,452 | S | * | 7/2000 | Aronov | D21/460 |
| 6,176,705 | B1 | * | 1/2001 | Garvey | A63H 3/00 434/284 |
| 6,540,580 | B1 | * | 4/2003 | Wolfram | A63H 1/30 446/250 |
| 6,719,606 | B1 | * | 4/2004 | Mukensturm | A63H 3/005 446/369 |
| D614,706 | S | * | 4/2010 | Lemesle | D21/460 |
| D786,984 | S | * | 5/2017 | Pouliot | D21/492 |
| 9,694,295 | B2 | * | 7/2017 | Walterscheid | A63H 3/003 |
| D861,800 | S | * | 10/2019 | Park | D21/484 |
| D883,399 | S | * | 5/2020 | He | D21/460 |
| D887,499 | S | * | 6/2020 | Manovi | D21/493 |
| D902,323 | S | * | 11/2020 | Park | D21/503 |
| 10,874,954 | B2 | * | 12/2020 | Anderson | A63H 33/067 |
| 2002/0102906 | A1 | * | 8/2002 | Fleisch | A63H 1/06 446/233 |
| 2003/0070954 | A1 | * | 4/2003 | Tyler | A63H 1/00 206/457 |
| 2013/0012099 | A1 | * | 1/2013 | Nielsen | A63H 1/20 446/256 |
| 2013/0324004 | A1 | | 12/2013 | Schwartz | |
| 2016/0089613 | A1 | * | 3/2016 | Stubenfoll | A63H 33/002 446/239 |
| 2016/0158662 | A1 | * | 6/2016 | Lee | A63H 33/086 446/128 |
| 2017/0340978 | A1 | | 11/2017 | Capusotto | |
| 2018/0008899 | A1 | | 1/2018 | Ainley et al. | |

FOREIGN PATENT DOCUMENTS

| | | | |
|---|---|---|---|
| CN | 202822751 | U | 3/2013 |
| CN | 204073411 | U | 1/2015 |
| CN | 107185248 | A | 9/2017 |
| GB | 223834 | A | 10/1924 |
| JP | 4044345 | B2 | 2/2008 |
| JP | 4150773 | B2 | 9/2008 |
| KR | 101818403 | B1 | 1/2018 |
| SE | 83579 | C1 | 6/1935 |
| WO | 2011/057636 | A1 | 5/2011 |

OTHER PUBLICATIONS

International Search Report and Written Opinion issued in corresponding international application No. PCT/EP2019/060797, dated Jun. 17, 2019. (8 pages).

First Office Action issued in corresponding Chinese patent application No. 201980041618.3, dated Sep. 3, 2021, 9 pages (English translation only).

* cited by examiner

TOY SPINNING TOP AND TOY SYSTEM WITH A TOY SPINNING TOP AND A TOY FIGURINE

CROSS-REFERENCE TO RELATED APPLICATIONS

This application is a U.S. National Stage of International Application No. PCT/EP2019/060797, filed on 26 Apr. 2019 and published on 31 Oct. 2019, as WO 2019/207133 A1, which claims the benefit of priority to Danish Patent Application No. PA 2018 70245, filed on 26 Apr. 2018. The content of each of the above referenced patent applications is incorporated herein by reference in its entirety.

The present invention relates to a toy spinning top (or simply spinner). The invention further relates to a toy system comprising a toy spinning top and a toy figurine.

DESCRIPTION OF RELATED ART

Toy spinning tops as such are known in the art. In the basic form, they comprise a spinner body and a handle part extending upwards from the spinner body. The handle is configured for transferring torque from the user's hand/fingers to the toy spinning top. Also, toy systems comprising toy spinning tops and a toy figurine are known in the art. With such toy systems users—such as children—may imagine play that the toy figurines are battling against each other, when two or more toy spinning tops are spinning at the same time. One such toy system is known from the US patent application published as US 2018/0008899 A1. In US 2018/0008899 A1, a rotor may be rotated by use of a cord driven release device. Inside the rotor, a toy figurine may be located. In order to protect the toy figurine, a full transparent cover is arranged over and lockable to the rotor. The rotor and the toy figurine can only be launched for spinning when the transparent cover is arranged over the toy figurine and rotor and locked thereto. This is a rather complex mechanism. The international patent application published as WO 2011/057636 A1 discloses a toy spinning top wherein a toy figurine may be arranged. The toy figurine is located in an ejector mechanism. The toy figurine is intended to carry a further building element formed e.g. as a bar or the like which extends beyond a perimeter of the toy spinning top. If the rotation of toy figurine is slowed relative to the rotation of the toy spinning top, which may happen if the bar held by the toy figurine hits another object, the toy figurine is ejected from the toy spinning top. Therefore, the toy figurine is not coupled to the toy spinning top, it is only standing in a bow shaped receptacle. WO 2011/057636 A1 thus teaches not to protect the toy figurine.

It is a problem with this prior art that the toy figurine or the bar connected thereto is easily lost when the toy spinning top impacts other objects.

There is thus a need for a simpler toy spinning top which may be spun without any launch device, and where a toy figurine and potentially further building elements held by the toy figurine may be protected within the toy spinning top.

SUMMARY OF THE INVENTION

In a first aspect of the invention the above mentioned objects as well as other objects are obtained by a toy spinning top for use in toy system, which toy system may comprise a toy figurine, where the toy spinning top comprises a spinner body with an elongate axis; a bottom wall; and a sidewall extending from the bottom wall, where the sidewall of the spinner body comprises a top rim; an outside surface; and an inside surface, where the bottom wall comprises an outside bottom surface; and an inside bottom surface, where the inner bottom surface comprises first connection means for releasably connecting second connection means formed on the toy figurine to the toy spinning top; and allowing transfer of torque from said toy figurine to said toy spinning top, and where the sidewall has a height from said inner bottom surface to said top rim which extends over a major part of the height of said toy figurine.

The toy figurine preferably has a humanoid form and may thus alternatively be called a humanoid toy figurine or humanoid toy figure.

The mentioned height of said toy figurine may be defined as the distance between the second connection means formed at a bottom end of the toy figurine, such as the at the bottom surface of the feet of the toy figurine, and the top of the head.

The sidewall having a height from said inner bottom surface to said top rim which extends over a major part of the height of said toy figurine, may in an embodiment mean that said height from said inner bottom surface to said top rim constitutes half or more than half of the total height of the toy figurine.

In an embodiment the height from said inner bottom surface to said top rim is configured such that it covers the toy figurine from the feet to the arms, thereof, when the toy figurine is coupled to the first connection means at the spinning top.

Thereby is obtained a toy spinning top which has an internal space, wherein a toy figurine may be releasably coupled to the toy spinning top, and where—when such a toy figurine is coupled/connected—it is secured that the toy figurine may be accessible for a user in order for transferring a torque from the toy figurine to the toy spinning top, and at the same time the toy figurine may be protected against impact for example when the spinning top is brought to spin.

In an embodiment the height from said inner bottom surface to said top rim is equal, or larger than, a height of the toy figurine from second connection means formed at one end of legs to a shoulder portion of a body formed between the legs and a head resting on said shoulder portion. In some embodiments the height from said inner bottom surface to said top rim is smaller than a total height of the toy figurine, e.g. as measured from the bottom of the feet to the top of the head of the figurine.

Thereby is obtained a toy spinning top which has an internal space, wherein a toy figurine may be releasably coupled to the toy spinning top, and where—when such a toy figurine is coupled/connected—secures that the head of the toy figurine extends above the top rim. Thereby, the head of the toy figurine can be used to manipulate, e.g. turn/rotate/spin the toy spinning top in order to initiate a spinning thereof. Further, it is ensured that any other body parts than the head of the toy figurine is arranged at or below the level of the top rim, including any body, feet, legs, arms or hands (or any further toy elements held in the hands), when the toy figurine is coupled/connected.

Thereby, the latter body parts can be protected within the internal space of the spinner body, e.g. when the toy spinning top is spinning, and/or being prepared for spinning.

In an embodiment of the toy spinning top, the spinner body is frusto-conically shaped.

In another embodiment the sidewall may forms an angle of 10-25° relative to the elongate axis.

In a further embodiment one or more openings/recesses/cut-outs may be formed in the sidewall at the top rim, such that the cut-out(s) extend from the top rim. Thereby, visual and/or physical access to the inside space and any building elements and/or toy figurines may be improved.

Any cut-outs may be formed pairwise, located on the top rim at opposite locations on the top rim. Alternatively, the cut-outs may otherwise be arranged equidistantly along the top rim.

In a further embodiment thereof, the top rim comprises third connection means for connecting to secondary toy building elements, e.g. for hingedly or pivotably connecting secondary toy building elements. The third connection means my be formed pairwise located at opposite locations on the top rim. Alternatively, the third connection means may otherwise be arranged equidistantly along the top rim. In some embodiments, each of said cut-outs is provided with third connection means for connecting to secondary toy building elements. Accordingly the spinner may easily be customized by the user by adding and arranging additional toy building elements which may extend radially outwards and/or upwards and/or downwards from the top rim without interfering with the spinning operation and while still allowing the spinner to be set in motion by imparting torque on the figurine.

In yet further embodiments, the toy spinning top according to any of the previously mentioned embodiments may further comprise a bottom building element having a rounded and smooth bottom surface, where the bottom building element is releasably connectable to fifth connection means formed at the outside bottom surface of the bottom wall of the spinner body. Having a smooth rounded shape on the lowermost surface of the toy spinning top reduces friction and thereby improves the spinning properties of the toy spinning top. By having fifth connection means formed on the lower/bottom surface of the spinner body ensures that the toy spinning top may interchangeably be connected to the bottom building element to function as a toy spinning top and to other building elements, for example to form part of a toy building construction.

In alternative embodiments the bottom surface of the bottom wall of the spinner body may have a smooth rounded shape to reduce friction and thereby improve the spinning properties of the toy spinning top.

In yet further embodiments, the toy spinning top according to any of the previously mentioned embodiments may further comprise a separator guard formed at the internal bottom surface. The separator guard is formed between individual parts (such as knobs) of the first connection means. Thereby, it is obtained that building elements without suitable corresponding separator guard receiving means, can be prevented from connecting to the first connection means at the internal bottom surface. This may prevent building elements, which for example due to their small size would be difficult to remove, if they were connected to the first connection means at the bottom of the internal space.

In yet further embodiments, the toy spinning top according to any of the previously mentioned embodiments may further comprise guide means formed at an intersection between the internal bottom surface and the inside surface of the sidewall. The guide means are formed adjacent to the first connection means. Thereby, the second connection means on the toy figurine may be guided toward the first connection means in order to ease the coupling. For example if the second connection means on the toy figurine, are formed at the extremity of legs which are individually pivotal relative to the body of the toy figurine, where the legs may not be in the same position when attempting a coupling of the first and second connection means, the guide means (or guides) may align the leg position and guide each of the second connection means towards the first connection means In yet further embodiments, the toy spinning top according to any of the previously mentioned embodiments may further comprise an outside spiralling ledge, formed in the outside surface of the side wall of the spinner body.

Additionally, or alternatively, an inside spiralling ledge may be formed in the inside surface of the spinner body.

In as second aspect of the invention the above mentioned objects as well as other objects are obtained by a toy system comprising

- a toy spinning top as defined in connection with any of the above mentioned embodiments of the first aspect of the invention; and
- a toy figurine.

In particular the toy figurine may comprise a body with a shoulder portion, legs extending from said body and at one end of which second connection means are formed; and a head on top of said shoulder portion, and said toy figurine having a second height from said second connection means to said shoulder portion.

In a particular embodiment the sidewall has a first height from said internal bottom surface to the top rim being equal to the second height of said toy figurine.

The toy figurine preferably has a humanoid form and may thus alternatively be called a humanoid toy figurine or humanoid toy figure.

Thereby is at least obtained a toy system, in which a toy spinning top has an internal space, wherein a toy figurine may be releasably coupled to the toy spinning top, and where—when such a toy figurine is coupled/connected—it is secured that the head of the toy figurine extends above the top rim. Thereby, the head of the toy figurine can be used to manipulate, e.g. turn/rotate/spin the toy spinning top in order to initiate a spinning thereof. Further, it is ensured that any other body parts than the head of the toy figurine is arranged at or below the level of the top rim, including any body, feet, legs, arms or hands (or any further toy elements held in the hands), when the toy figurine is coupled/connected. Thereby, the latter body parts can be protected within the internal space of the spinner body, e.g. when the toy spinning top is spinning, and/or being prepared for spinning.

It should be emphasized that the term "comprises/comprising/comprised of" when used in this specification is taken to specify the presence of stated features, integers, steps or components but does not preclude the presence or addition of one or more other features, integers, steps, components or groups thereof.

BRIEF DESCRIPTION OF THE DRAWINGS

In the following, the invention will be described in greater detail with reference to embodiments shown by the enclosed figures. It should be emphasized that the embodiments shown are used for example purposes only and should not be used to limit the scope of the invention.

DETAILED DESCRIPTION OF THE EMBODIMENTS

Figure 1:
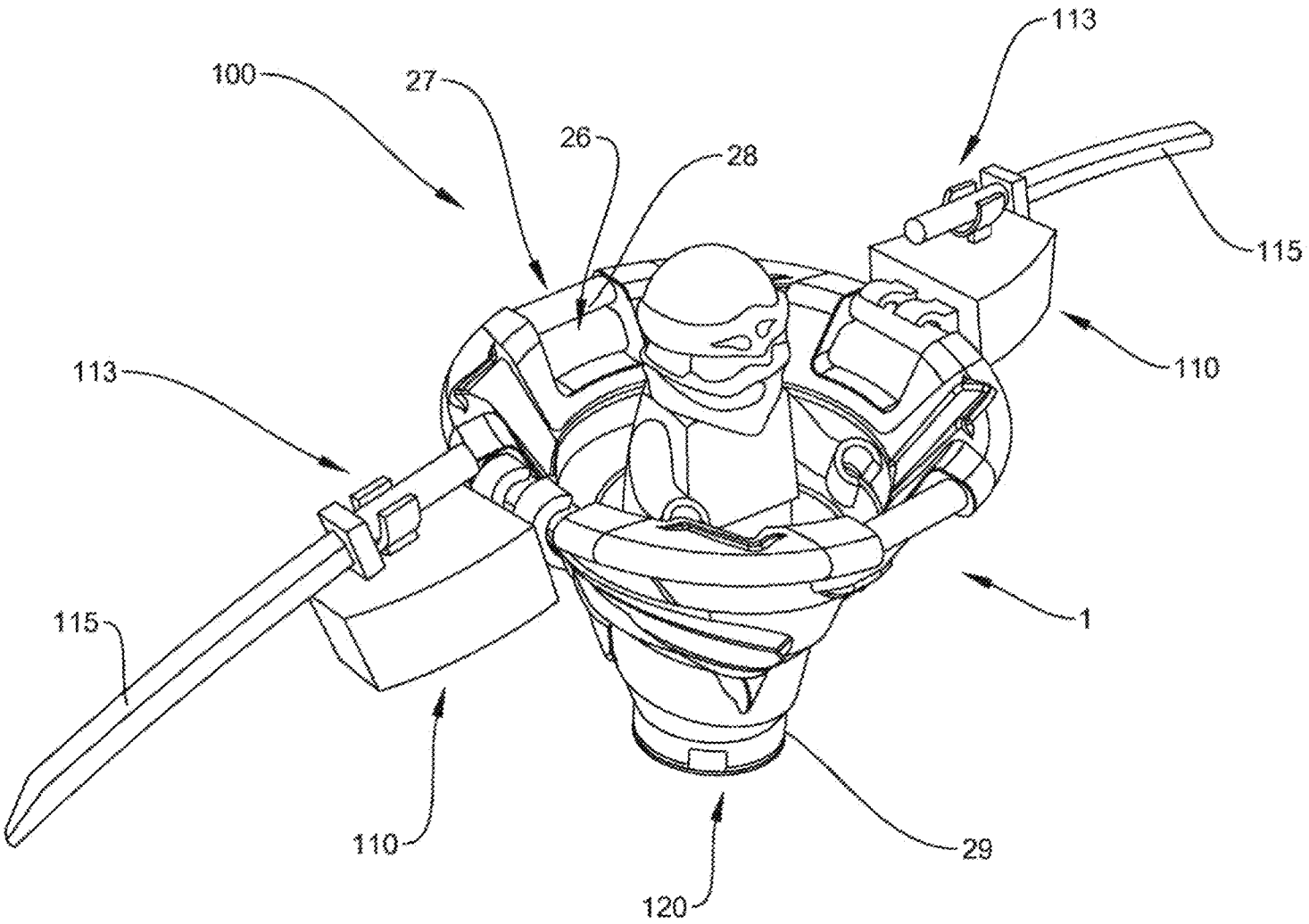
FIG. 1, in a perspective view from above, shows a toy system according to an aspect of the invention, the toy system comprising a toy spinning top, a toy figurine, a bottom building element, and further toy building elements, and where the parts of the system are assembled.

FIG. 1 shows a toy system 100 according to an aspect of the invention, the toy system comprising a toy spinning top 1 and a toy figurine 50. In FIG. 1 the toy figurine 50 is coupled to the toy spinning top 1.

The toy figurine 50 preferably has a humanoid form and may thus alternatively be called a humanoid toy figurine or humanoid toy figure.

In embodiments, the system 100 may further comprise secondary toy building elements 110 as shown in FIG. 1, where the secondary toy building elements 110 are shown coupled to the toy spinning top 1. In yet further embodiments, and as shown in FIG. 1, the toy system 100 may further comprise tertiary toy building elements 115. In FIG. 1 the tertiary toy building elements 115 are shown coupled to the secondary toy building elements 110.

Another aspect of the invention relates to a toy spinning top 1 as such. Such a toy spinning top 1 may be used in a toy system 100 as introduced in the previous paragraphs.

Figure 7:
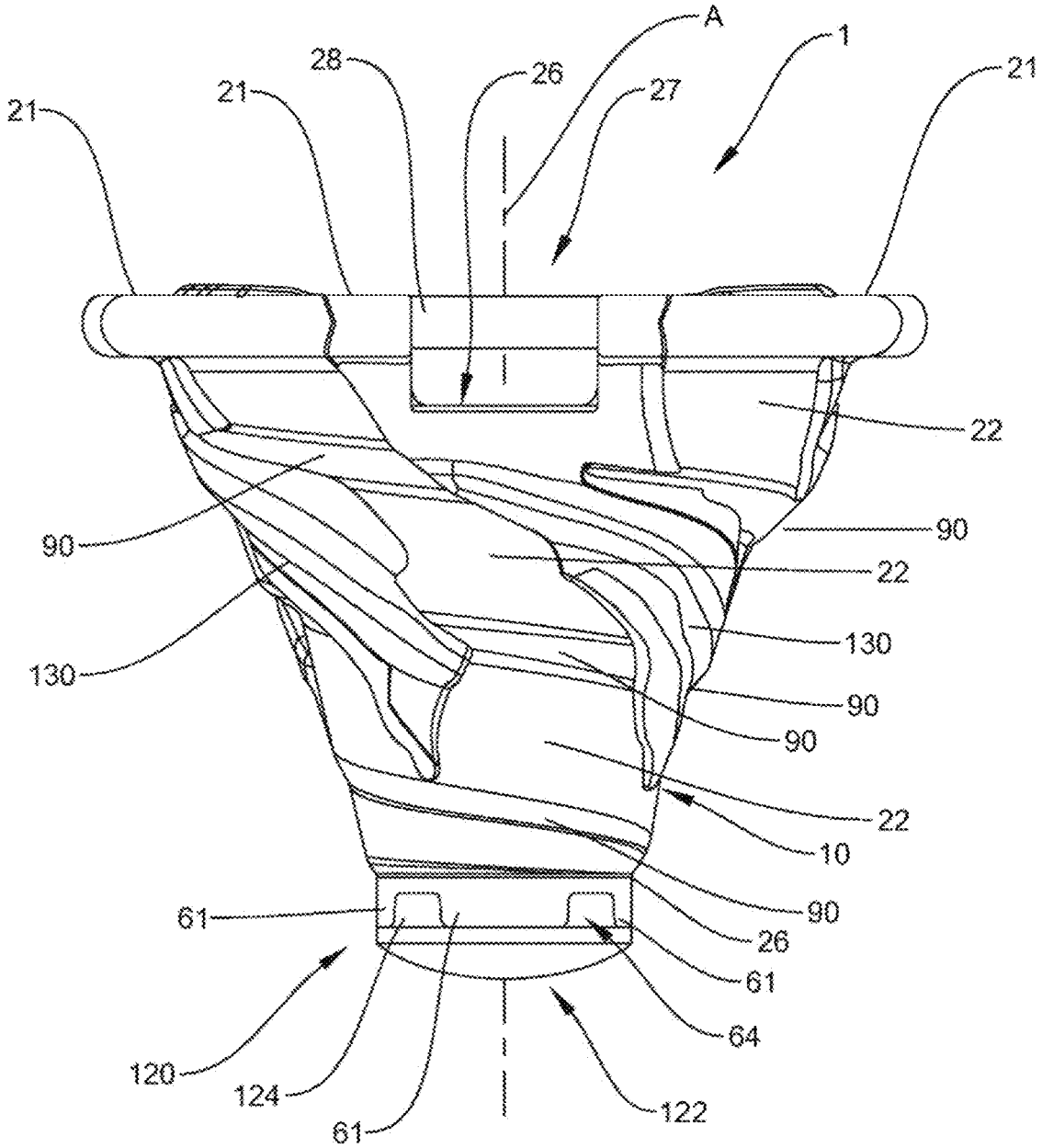
FIG. 7, in a side view, shows a toy spinning top according to an aspect of the invention.
Figure 8:
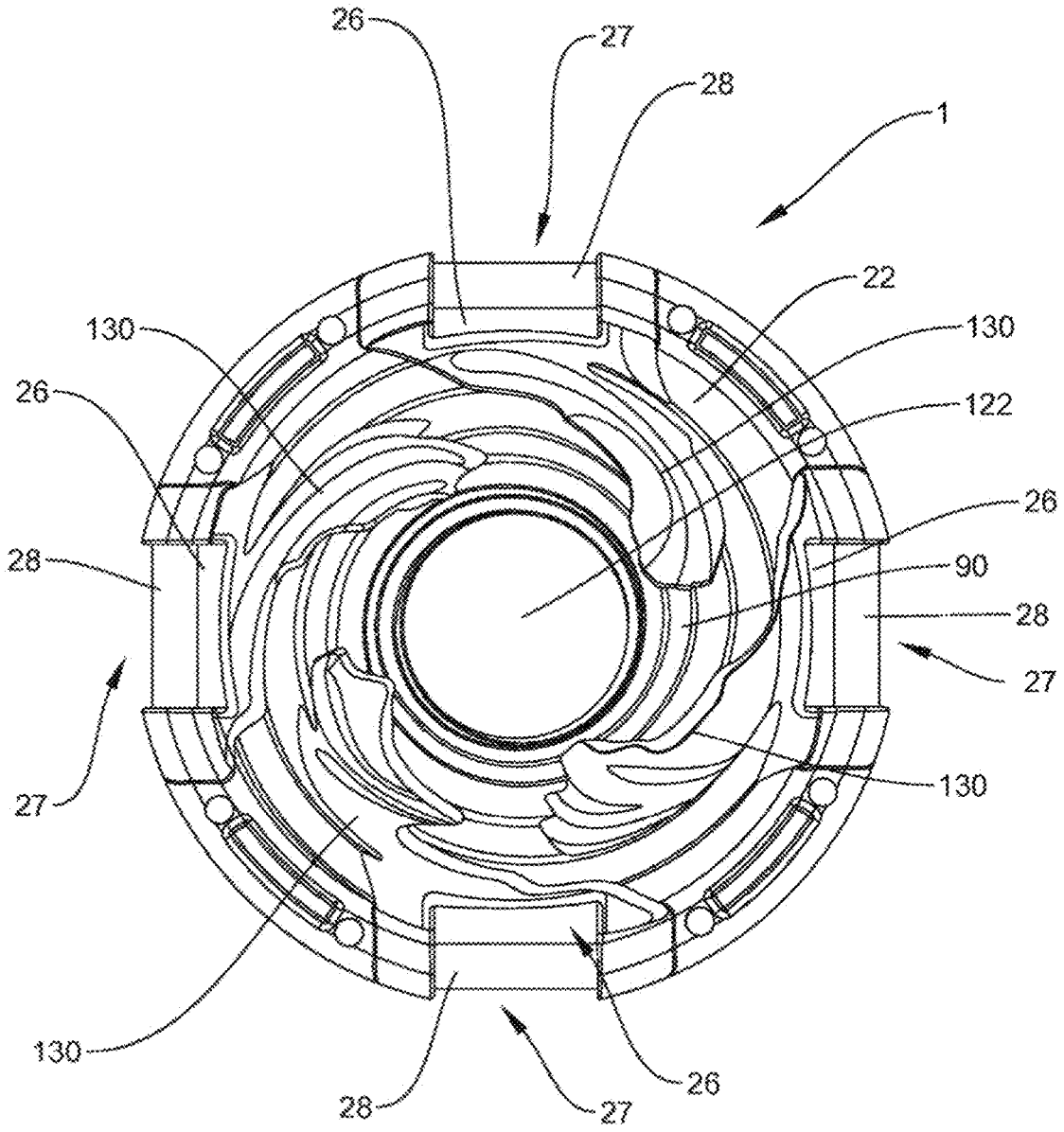
FIG. 8, in a bottom view, shows the toy spinning top of FIG. 7.
Figure 9:
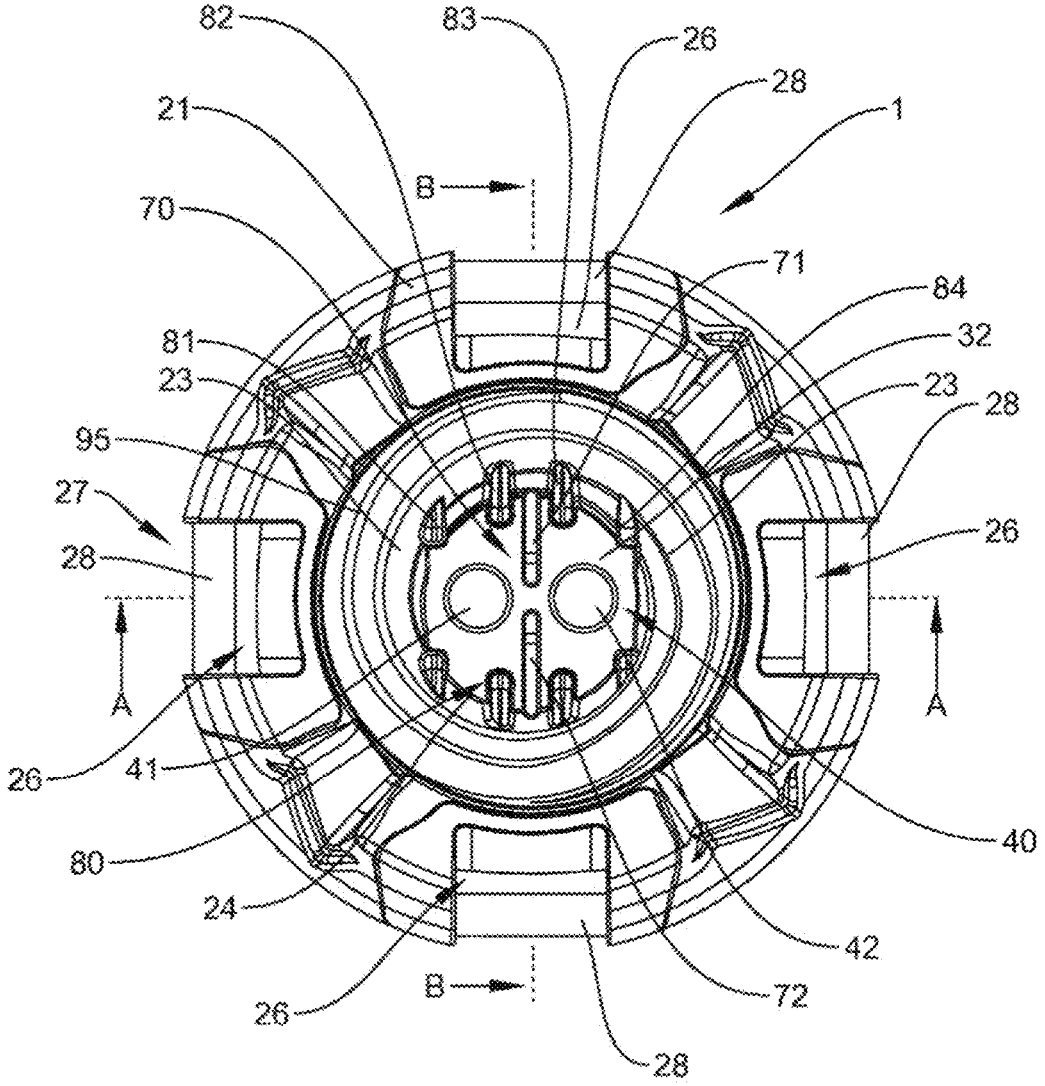
FIG. 9, in a top view, shows the toy spinning top of FIG. 7.
Figure 10:
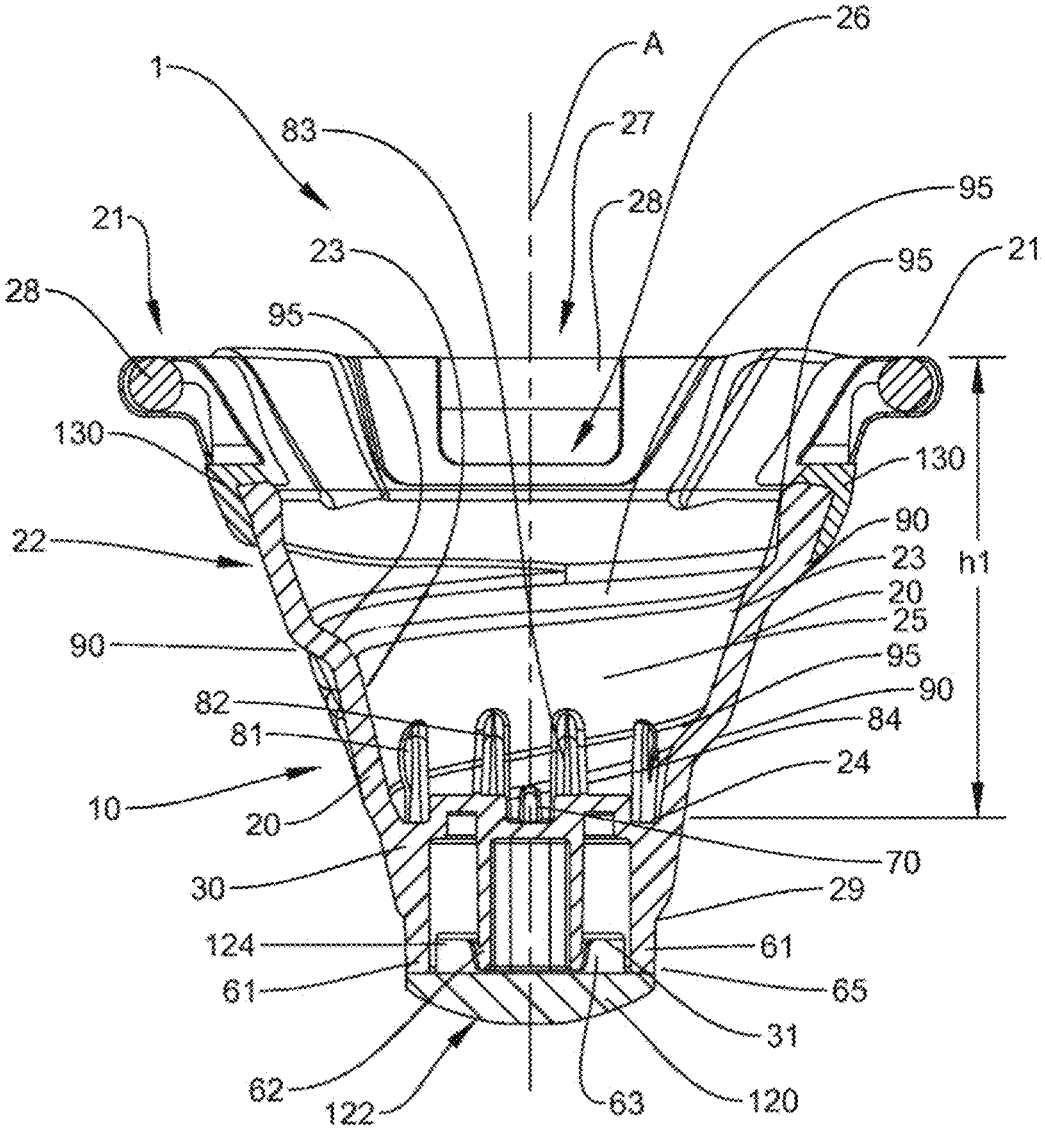
FIG. 10, in a side sectional view, shows the toy spinning top of FIGS. 7-9, in a section A-A shown in FIG. 9.
Figure 11:
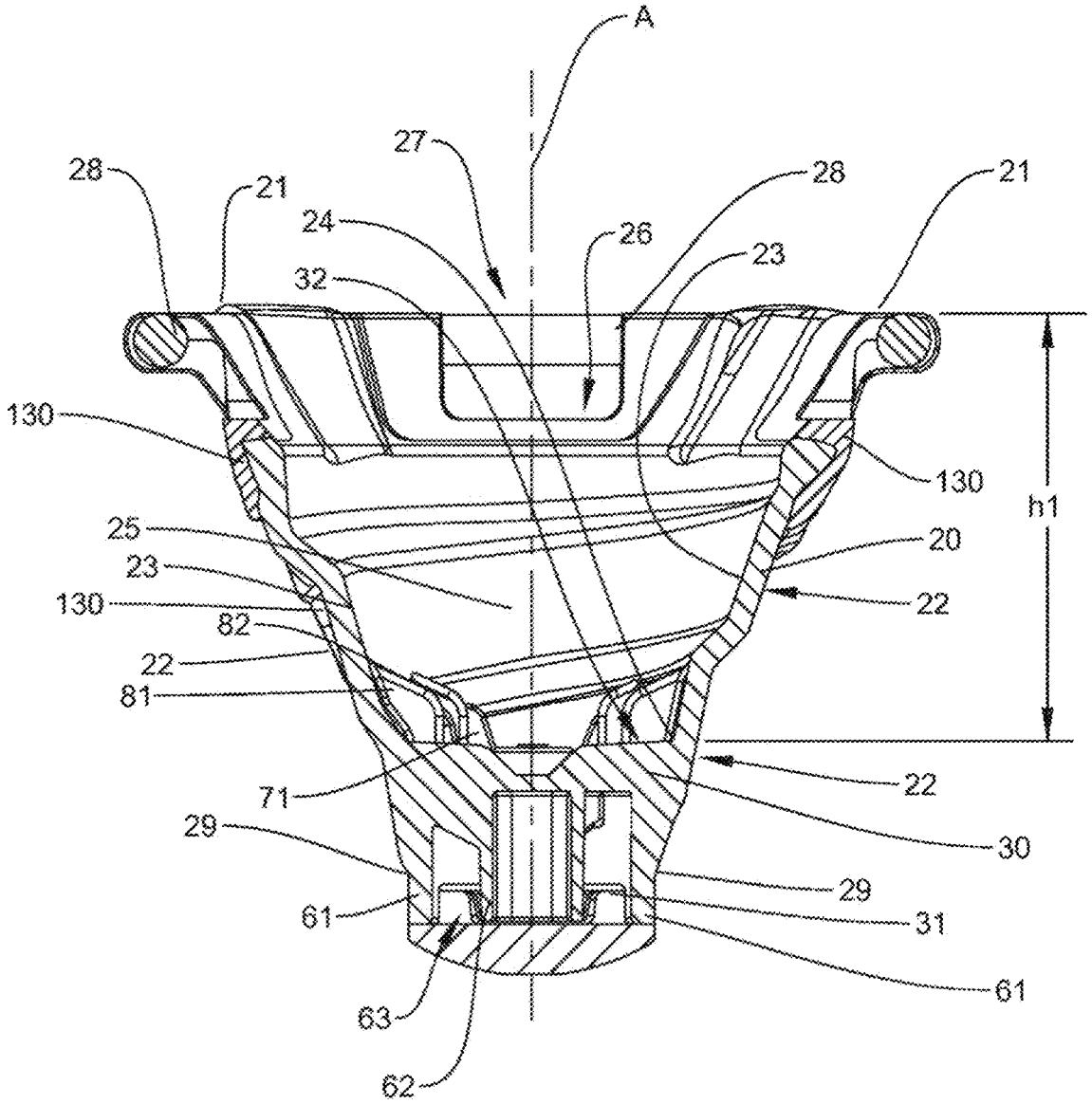
FIG. 11, in a side sectional view, shows the toy spinning top of FIGS. 7-10, in a section B-B shown in FIG. 9.

Referring now to e.g. FIGS. 7, 10 and 11, the toy spinning top 1 comprises a spinner body 10. FIG. 7 shows the toy spinning top in a side sectional view. FIG. 10 shows a section A-A, indicated in FIG. 9, of the toy spinning top of FIGS. 7-9. Likewise, FIG. 11 shows a section B-B indicated in FIG. 9, of the toy spinning top of FIGS. 7-9.

The spinner body 10 has an elongate axis A, which corresponds to the rotational axis of the toy spinning top 1, i.e. the spinner body 10 may generally be considered to be rotationally symmetrical.

The spinner body 10 has a sidewall 20 and a bottom wall 30. The sidewall 20 extends upward from said bottom wall 30. Preferably, at least portions of the sidewall 20 and the bottom wall 30 are formed integrally, e.g. moulded in plastic. In FIGS. 10 and 11 the striation of the sectional view indicates that the side wall 20 and the bottom wall are formed as an integrated unit.

The sidewall 20 further comprises an outside surface 22 and an inside surface 23. Thereby, the bottom wall 30 and the sidewall 20 defines an internal space 25 of the spinner body 10, see also FIGS. 2 and 13. As may be appreciated from e.g. FIGS. 2, 10, 11 and 13, the internal space 25 is open in an upward direction, the sidewall 20 having a top rim 21.

The sidewall 20 may, as shown in e.g. FIGS. 10 and 11, taper from said top rim 21 downwards towards said bottom wall 30. Thereby, the spinner body 10 of the toy spinning top 1 may have a general frusto-conically shape. Likewise the internal space 25 may have a frusto-conically shape.

The bottom wall 30 comprises an outside bottom surface 31, see e.g. FIG. 10 and an internal bottom surface 32, see e.g. FIGS. 9 and 10.

The internal bottom surface 32 connects to a lower internal rim 24 of the inside surface 23 of the sidewall 20, see for example FIGS. 9-11. The sidewall 20 has a height, first height h1, from said inner bottom surface 32 to said top rim 31. Height, h1 is illustrated in FIGS. 10 and 11. The height h1 can thus also be defined as the depth of the internal space 25.

The internal bottom surface 32 is preferably generally flat and sized to allow a contact to a lower surface of feet 56 of the above mentioned toy figurine 50, i.e. such that the toy figurine 50 may be arranged to stand on said internal bottom surface 32. The internal bottom surface 32 may preferably be circular. The internal bottom surface 32 may preferably have a diameter in the order of 1.5 to 2 cm.

Preferably, the sidewall 20 forms an angle of 10-25° relative to said elongate axis A. Thereby, sufficient room may be provided for the toy figurine 50 to be coupled to the toy spinning top 1.

Figure 3:
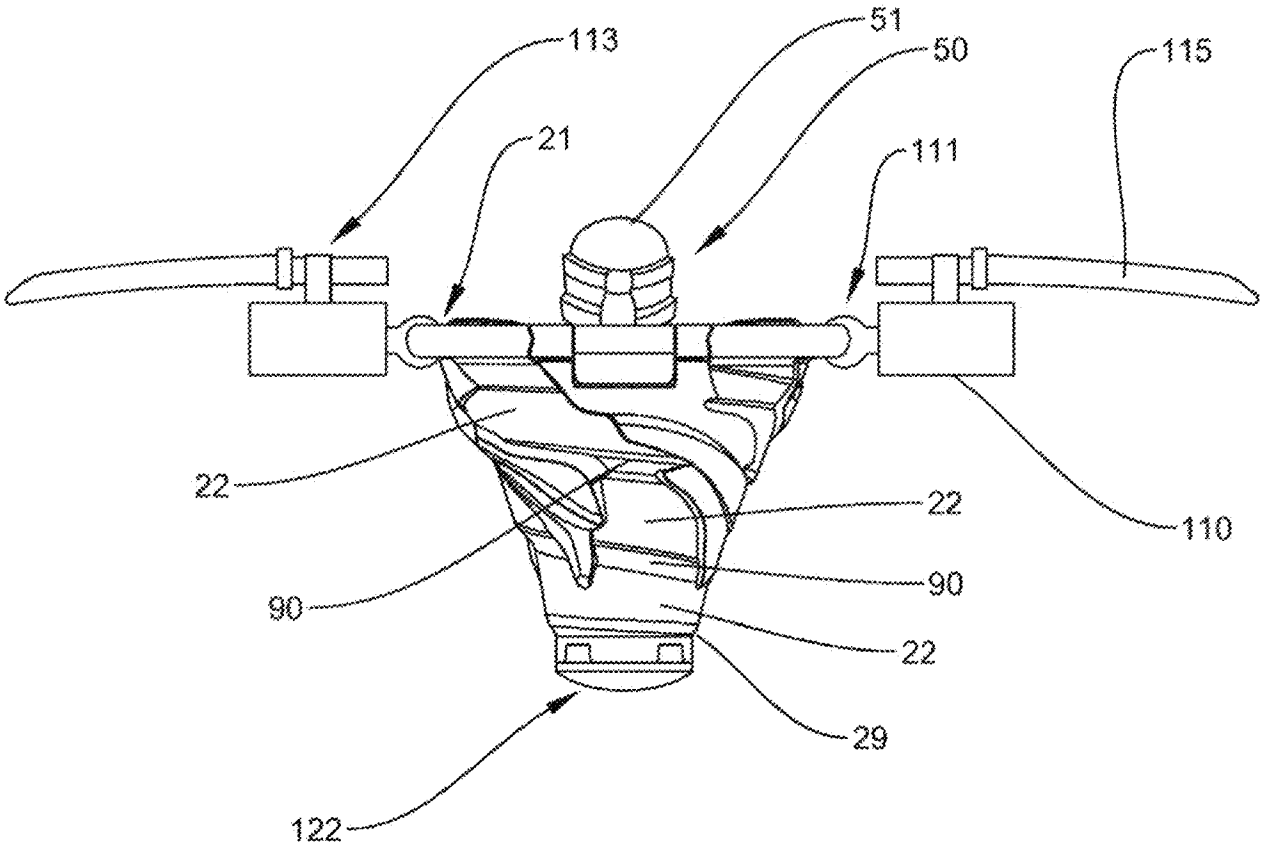
FIG. 3 shows the toy system of FIG. 1 in a front view.

As shown in e.g. FIGS. 3 and 7, the spinner body 10 may further comprise an outside spiralling ledge 90 formed in the outside surface 22. The spinner body 10 may further, and as shown in e.g. FIGS. 9-11, comprise an inside spiralling ledge 95 formed in the inside surface of side 23 of the sidewall 20.

Due to the taper of the spinner body 10 the outside spiralling ledge 90 faces downward, and the inside spiralling ledge 95 faces upward.

The spiralling ledges 90, 95 extend in the outside surface 22 and/or inside surface 23 from the top rim 21 to the lower part of the sidewall 20, i.e. to the lower internal rim 24 in the inside surface 23 of the sidewall 20, and to the external lower rim 29 in the outside surface 22 of sidewall.

Preferably the outside spiralling ledge 90 and the inside spiralling ledge 95 follow each other, such that the downwardly facing outside ledge 90 in the outside surface 22 corresponds to or forms the opposite side of the upwardly facing inside ledge 95 at a corresponding position along the spirals. When the toy spinning top 1 is spun/rotated this spiralling may provide visual effects similar to a tornado. However, in the internal space 25 the ledge 95 may further provide room for the arms 54 and hands 59 (and potential toy building elements connected to the hands 59).

Figure 2:
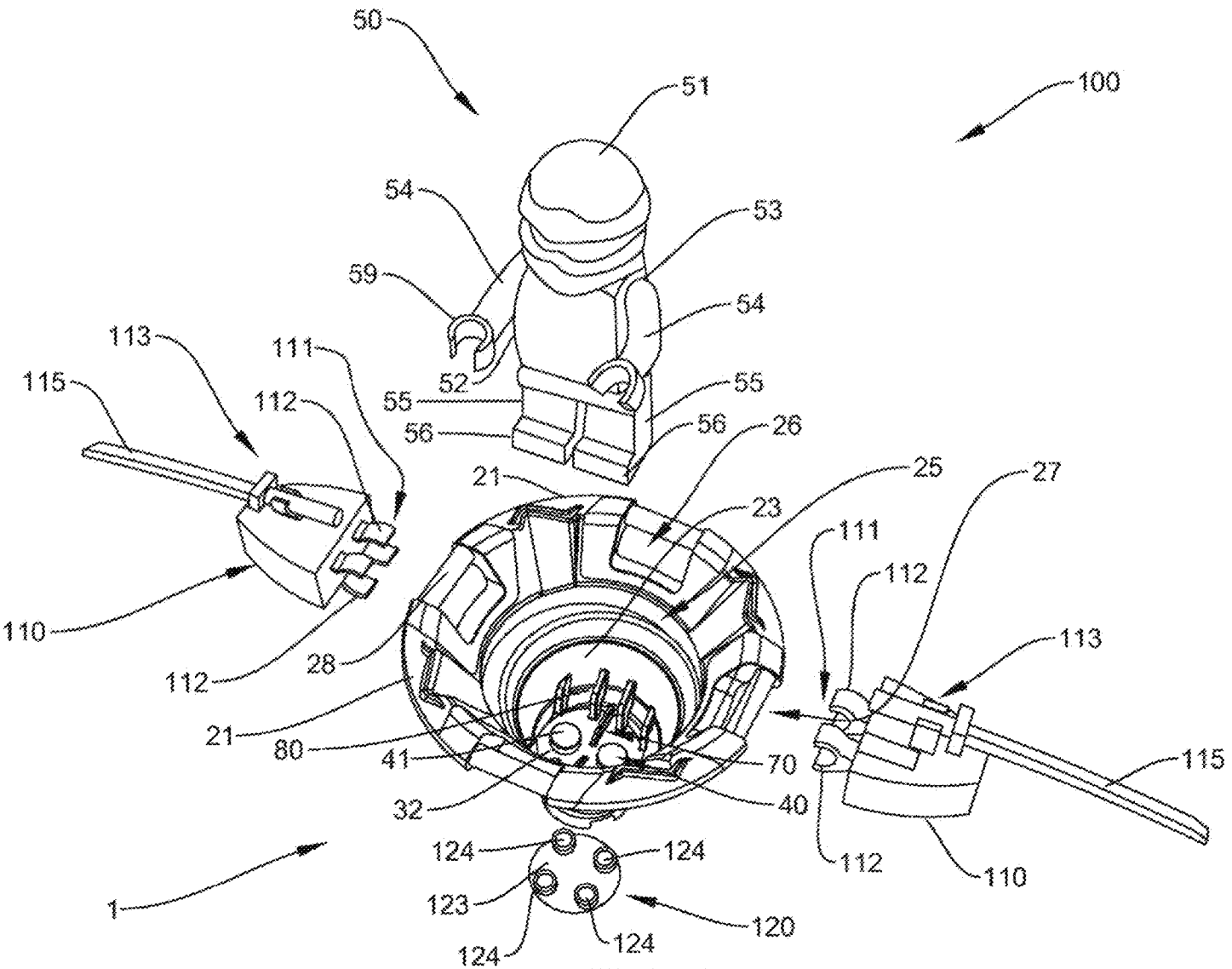
FIG. 2, in an exploded perspective view from above, shows the toy system of FIG. 1 from a different angle than in FIG. 1, where the toy spinning top, the toy figurine, the bottom building element, and the further toy building elements are disassembled from each other.
Figure 13:
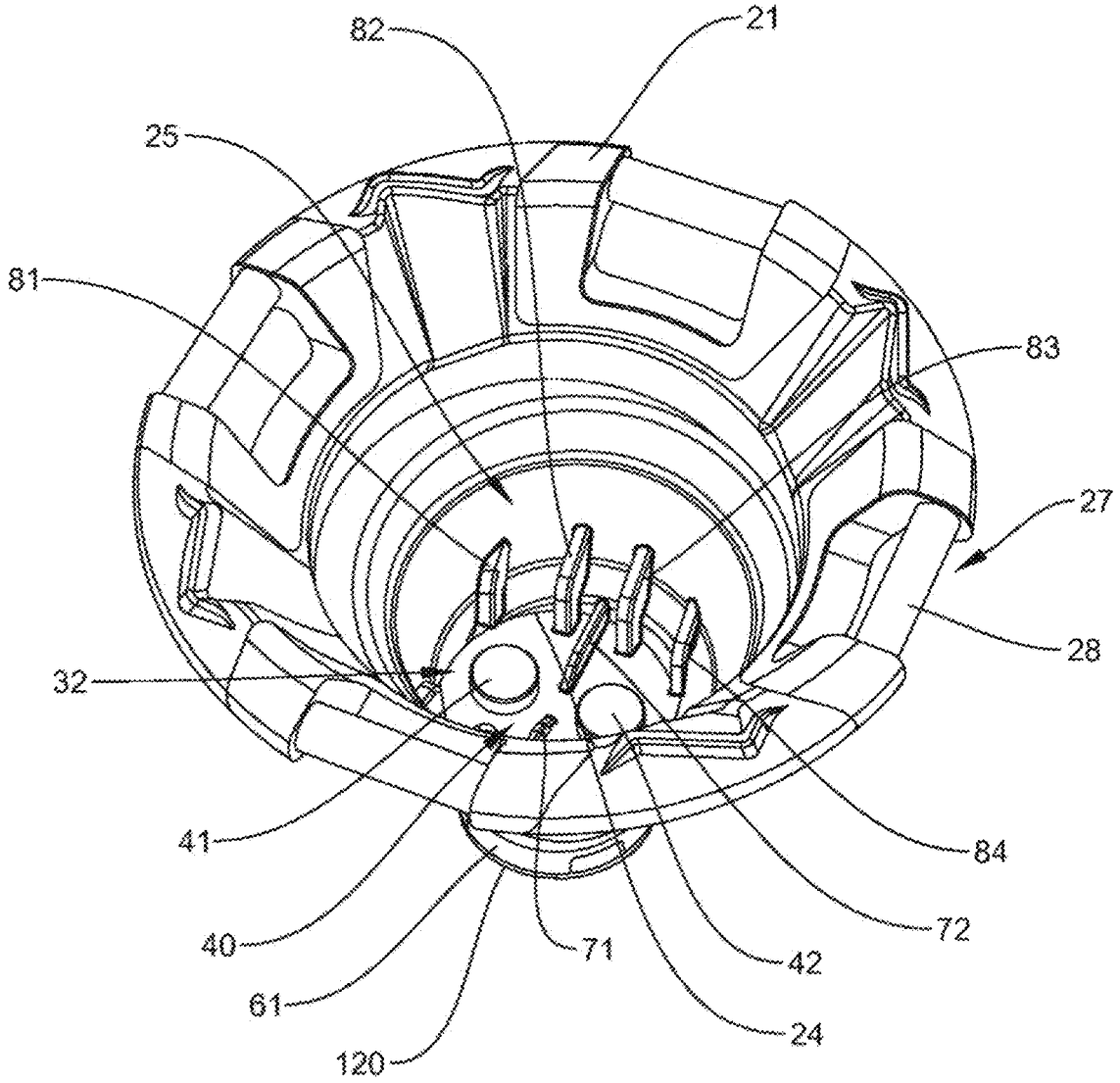
FIG. 13, in a perspective view, shows the toy spinning top of FIGS. 7-12 from above.

Preferably, and as shown in e.g. FIGS. 2 and 13 the internal bottom surface 32 comprises first connection means 40 for releasably connecting the feet 56 of the toy figurine 50 to the toy spinning top 1. This will be described in further detail below. Preferably, the first connection means comprise knobs 41, 42.

Figure 4:
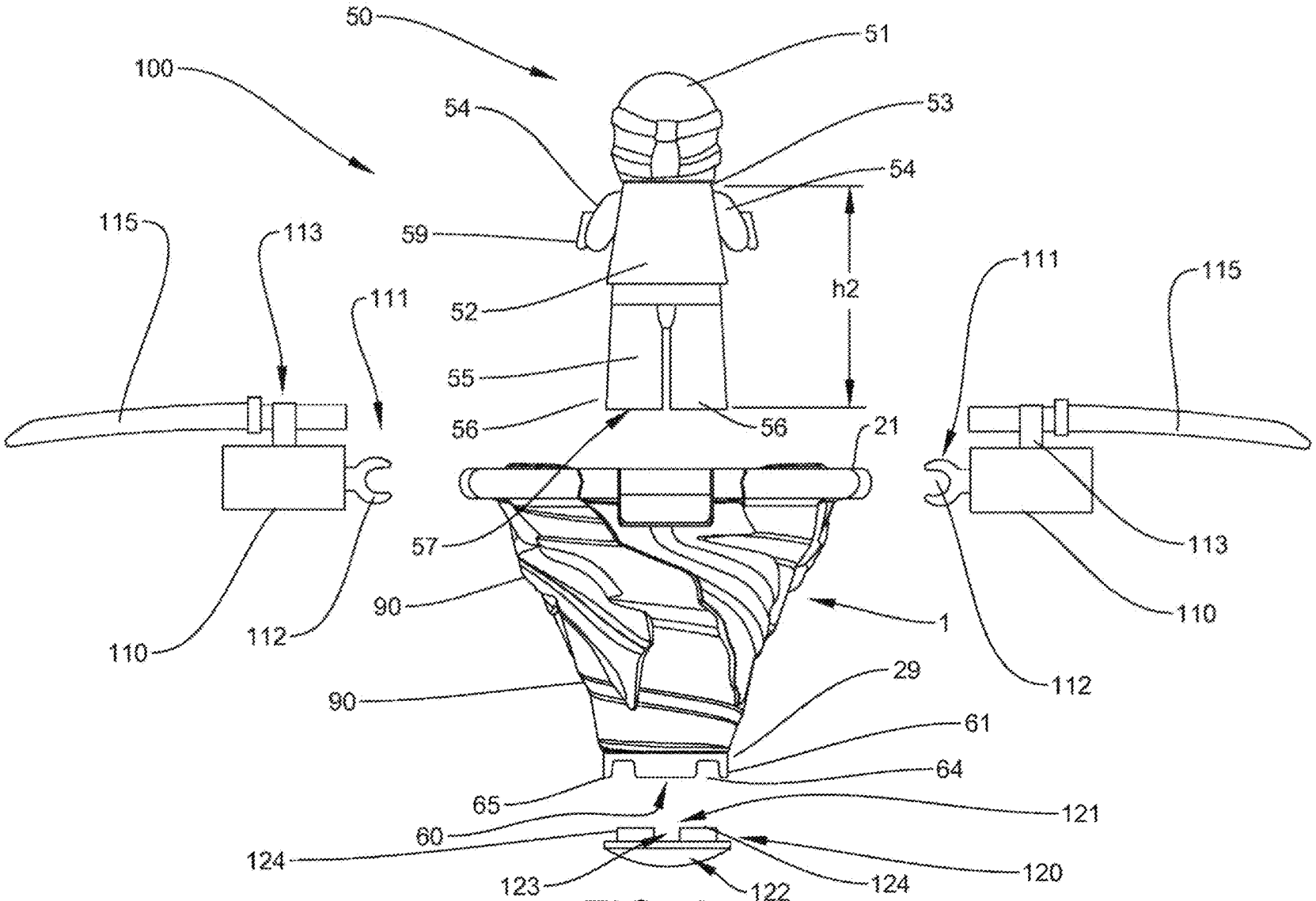
FIG. 4 shows the toy system of Fig. in a back view.
Figure 5:
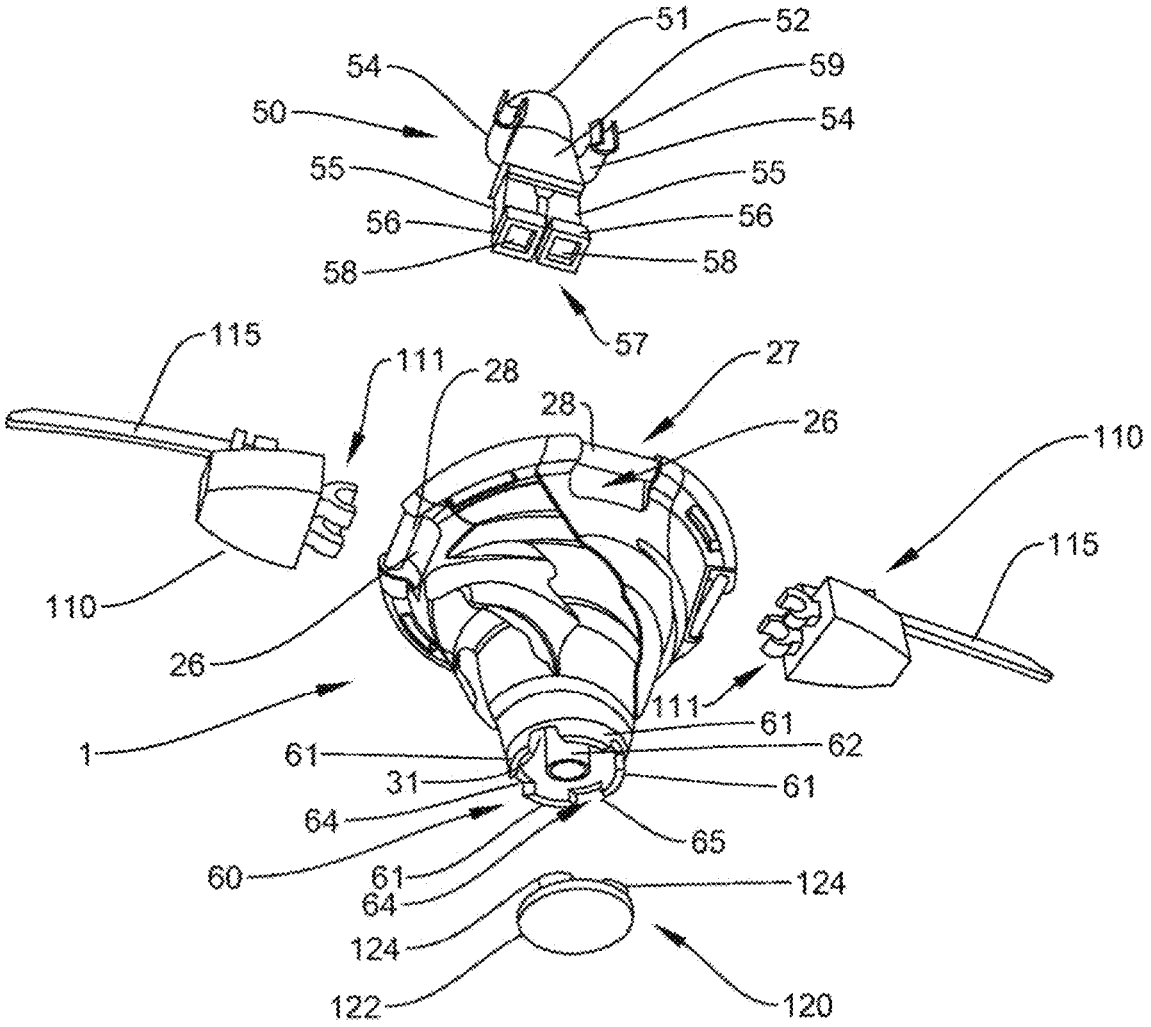
FIG. 5, in an exploded perspective view show the disassembled toy system of FIG. 2 from bellow.
Figure 6:
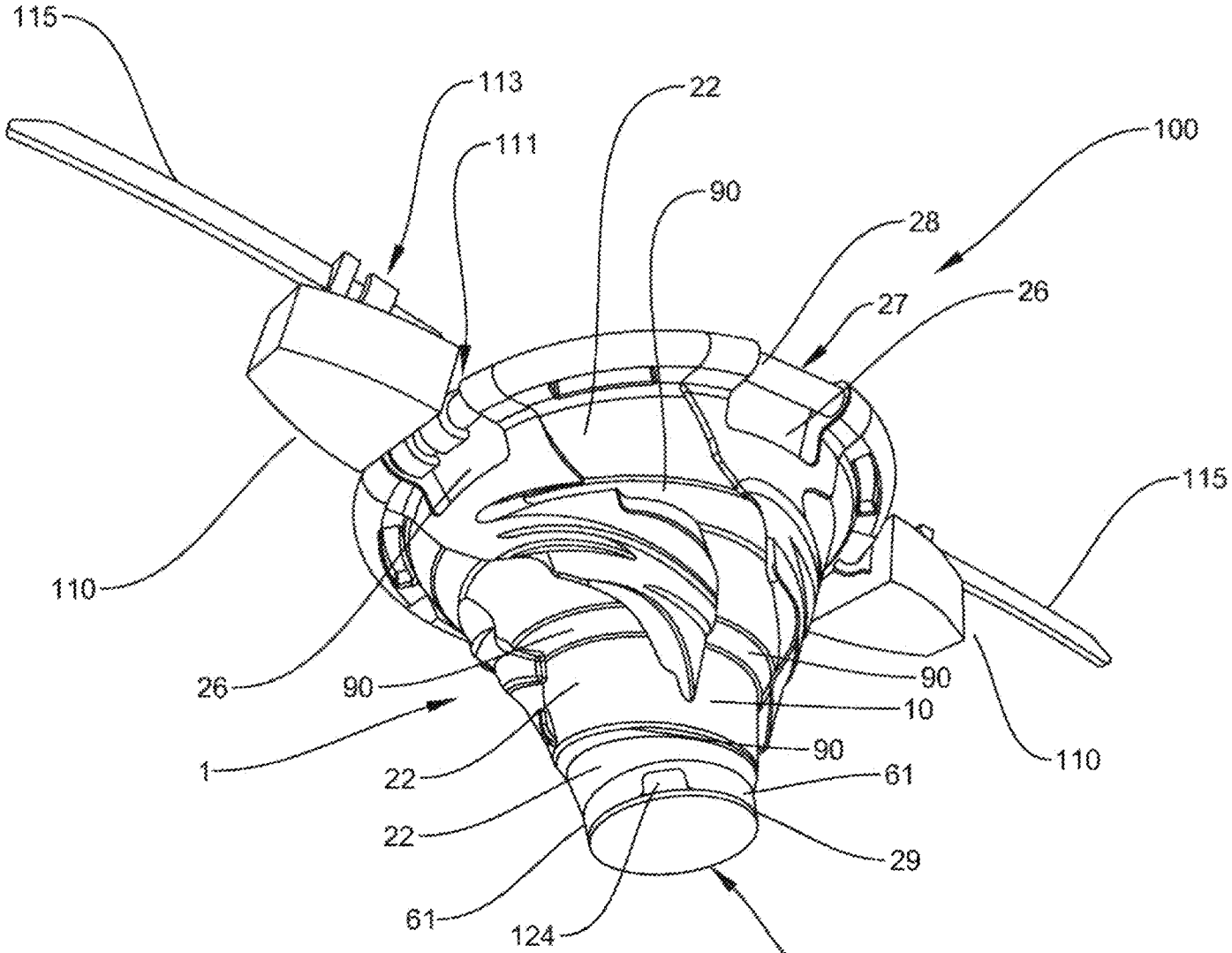
FIG. 6, in perspective view, shows the toy system of FIG. 1 seen from below.

The toy figurine 50, see for example FIG. 2, 4 or 5, at a lowermost end comprises feet 56 formed in extension of legs 55. The toy figurine 50 may comprise two legs 55. The legs 55 are formed extending from below a body 52. Each foot 56 comprises a bottom surface. The bottom surface of each foot 56 preferably forms a flat planar surface. The flat planar surface of the bottom surface of the feet, allows the toy figurine 50 to stand on a surface. The body 52 of the toy figurine 50 comprises a shoulder portion 53 from which arms 54 extend. The toy figurine 50 may comprise two arms 54. A head 51 is arranged on top of said body 52. Thus, the head extends from said shoulder portion 53. A hand 59 may extend from each of said arms 54. The hands may be formed as connection means allowing connection of toy elements (such as the tertiary toy building elements 115 shown in FIG. 1, and mentioned above) to the hands 59. Each of the two legs 55 may be individually rotatable relative to the body 52. Each of the two arms 54 may be individually rotatable relative to the body 52.

As shown in FIG. 4, the toy figurine 50 has a second height h2 from the bottom of the feet 56 to the shoulder portion 53, i.e. the top of the body 52.

The feet 56 are provided with second connection means 57 preferably formed as indentations 58, see FIG. 5, in a bottom surface of the feet 56. Preferably one indentation 58 is formed in each of the feet 56. The second connection means 57 are configured for cooperating with first connection means 40 at least on the toy spinning top 1, as mentioned above and as described in further detail below. Preferably, the internal bottom surface 32 of the toy spinner 1 is provided with two knobs 41, 42 arranged to cooperate with the indentations formed in the feet 56.

Preferably, and as shown in FIGS. 2, 9-10, and 13, the first connection means 40 may be formed as knobs/protrusions 41, 42 configured in shape and size to the second connection means 57, i.e. the indentations 58. It will be appreciated that in alternative embodiments, the indentations 58 may be formed in the inside bottom surface 32 of the bottom wall 30 of the spinner body 10, and corresponding knobs 41, 42 may be located on bottom surface of the feet of the toy figurine. It will also be appreciated that the cooperating/mating first and second connections means may be replaced by other types of complementary connection means.

Preferably, the complementary cooperating/mating first and second connections means 40 and 57 are configured as a snap or friction connection.

Preferably, the complementary cooperating/mating first and second connections means 40 and 57 are configured such that the connection between the toy figurine 50 and toy spinner 1 at least allows a user to lift the toy spinner 1 though lifting the toy figurine 50.

Preferably the first height h1, i.e. the height of the sidewall 20 from said inner bottom surface 32 to said top rim 21, is equal to a second height h2, i.e. the height of said toy figurine 50 from the bottom of the feet 56 to the shoulder portion 53, i.e. the top of the body 52.

FIG. 3 shows the a toy figurine 50 coupled to the first connection means 40 at the internal bottom surface 32 of the toy spinning top. The above mentioned relationship between the first height, h1, and the second height h2, thereby secures that the head 51 of the toy figurine 50, extends above the top rim 21. Thereby, the head 51 of the toy figurine 50 can be used to manipulate, and turn/rotate/spin the toy spinning top 1 in order to initiate the spinning thereof. Further, it is ensured that the body parts of the toy figurine 50 at or below the level of the shoulder portion 53 (and thereby below the top rim 21)—when mounted to the internal bottom surface 32 of the bottom wall 30—including body 52, feet 56, legs 55, arms 54 and hands 59 (and toy elements held in the hands 59), can be protected within the internal space 25 of the spinner body 10, e.g. when the toy spinning top 1 is spinning, and/or being prepared for spinning.

The mentioned height relation further results in that the head 51 of the toy figurine 50, when mounted to the internal bottom surface 32 of the bottom wall 30, extend above the top rim 21, and thereby allows a user to manipulate the head to spin the toy system 100 comprising the toy spinning top 1 and the toy figurine 50 connected thereto.

Cut-outs 26 may be formed in the sidewall 20 at the top rim 21 of the spinner body 10. As shown in e.g. FIG. 9, four cut-outs are formed in the spinner body. However, in other embodiments there may be one, two, three, five or six cut-outs 26 formed in the top rim. The cut-outs may be arranged pairwise opposite to each other on top rim 21. However, generally it is preferred that the cut-outs 26 are arranged equidistantly along the top rim 21.

The cut-outs 26 are preferably rectangular. The cut-outs 26 may allow visual inspection of the internal space 25 of the spinner body 10. Further, the cut-outs may allow location of third connection means 2 at the top rim 21 of the sidewall 20 of the spinner body 10. The third connection means 27 are arranged for connecting to further, secondary toy building elements 110, e.g. such that the secondary toy building elements 110 are connected to the spinner body 10, but (also) on the outside thereof (relative to the internal space 25). There, may be third connection means 27 formed in all cut-outs 26 or in only some of them.

Referring now to FIG. 2, the secondary toy building elements 110 may comprise fourth connection mean 111, which are complementary to the third connection means 27.

Preferably, the third connection means 27 are formed as cylindrical bars 28, and the fourth connection means 111 on the secondary building elements 110, may be formed as C-shaped gripping claws 112 having an entrance slightly smaller than the diameter of the cylindrical bars 28, and the gripping bar being formed with a resilience allowing a user to click the secondary building elements 110 onto the cylindrical bars 28. Thereby, a hinged connection/coupling of the spinner body 10 to a secondary building element 110 may be obtained.

The outside bottom surface 31 of the bottom wall 30 of the spinner body 10 may be rounded and smooth (not shown) in order to reduce friction and thereby allow the toy spinning top 1 to spin better.

However, in the embodiments shown in the figures, the outside bottom surface 31 is provided with fifth connection means 60 which are complementary to sixth connection means 121 on a bottom building element 120.

Preferably, the bottom building element 120 has as rounded and smooth bottom surface 122 opposite to a surface 123 carrying the sixth connection means 121. Preferably, the sixth connection means 121 are formed as knobs/protrusions 124, see e.g. FIG. 2, configured in shape and size to cooperate with the fifth connection means 60.

Referring now to FIG. 5, the fifth connection means 60 are preferably formed with a recessed cylindrical flange 61 extending downwards from the lower surface 31 of the bottom wall 30, and a central cylindrical stud 62 also extending downwards from the lower surface 31 of the bottom wall 30. The recessed cylindrical flange 61 and the central cylindrical stud 62 are coaxially arranged. Thereby, a ring shaped space 63 is formed between the recessed cylindrical flange 61 and the central cylindrical stud 62. The recessed cylindrical flange 61 preferably has a number of openings/recesses/cut-outs 64 corresponding to the number of knob/protrusion 124 on the bottom building element 120. In e.g. FIGS. 4 and 5, four cooperating knobs 124 and cut-outs 64 are shown.

The cut-outs 64 are formed in a lower rim 65 of the cylindrical flange 61, and are preferably rectangular in shape.

In order to couple the fifth 60 and sixth 121 connection means, the knobs 124 are pressed into the ring shaped spaced, which is slightly smaller than a diameter of the knobs 124, whereby the knobs 124, the ring shaped space 63 and the cut-outs 64 forms a press fit.

FIGS. 1, 3, 6, 7, 8, and 10-13 shows the bottom building element 120 connected to the spinner body 10. FIGS. 2, 4 and 5 shows the bottom building element 120 disassembled from the spinner body 10.

It will be appreciated that the fifth and sixth connection means 60, 121 may be located on reverse parts. It will also be appreciated that the cooperating/mating fifth and sixth connections means 60, 121 may be replaced by other types of complementary connection means.

As shown in e.g. FIGS. 2, 9 and 13, the first connection means 40 formed at the internal bottom surface 32 of bottom wall 30 are formed as two knobs/cylindrical protrusions 41, 42 extending from said internal bottom surface 32. These knobs 41, 42 are, as mentioned above, configured for cooperating with two indentations 58, one in each foot 56 of the toy figurine 50. The two knobs 41, 42 are preferably formed on a first diameter of the internal bottom wall, and such that each of the two nobs are formed equidistantly from the centre of the circular internal bottom surface 32. In an embodiment, and as shown in for example FIGS. 2, and 9-11, one or more separator guards 70 may be formed as plates or ridges 71, 72 extending upwardly from the internal bottom surface 32. The one or more plates/ridges 71, 72 are formed in line with each other and along a line which is orthogonal to the first diameter on which the knobs 41, 42 are formed. The width of the plates/ridges 71, 72 is preferably configured/dimensioned such that it is complementary with a width/distance between the legs 55 of the above mentioned toy figurine 50. Thereby, the separator guard 70 allows the specific toy figurines 50 to be coupled to the first connection means 40 of the toy spinning top 1, and will prevent the coupling of other building elements, which do not have a separating distance between legs or portions of the building elements. Thereby, it may prevented that building elements, which would be difficult to access and remove in the internals space 25, are coupled to the first connection means 40.

In further embodiments and as also shown in FIGS. 2, and 9-11, the toy spinning top 1 may further comprise guide means 80, configured for guiding the second connection means 57 on the feet 56 of the toy figurine 50 towards the first guide means 40, provided on the internal bottom surface 32 of the toy spinning top 1. The guide means 80 are preferably be provided as a number of guide flanges 81, 82, 83, 84 extending upwards from the internal bottom surface 32 and inwards from the lower part of the inside surface 23 of the sidewall 20. The guide flanges 81, 82, 83, 84 are preferably plate-like and arranged in parallel with each other, and orthogonally to said first diameter defined by the location of the knobs 41, 42 as described above. The guide flanges 81, 82, 83, 84 are preferably formed along the sidewall 20, such that they do not extend all the way to the mentioned first diameter. The length of each of the guide flanges 81, 82, 83, 84 is preferably configured to allow the feet 56 of the toy figurine 50 to stand on the internal bottom surface 32, and allowing the first and second connection means 40, 57 to connect. Preferably, the guide flanges 81, 82, 83, 84 slope downwards from the sidewall 20 and towards the first diameter.

In the embodiment shown in the figures, there are four guide flanges 81, 82, 83, 84 formed on either side of the first diameter. It will be appreciated that in not shown embodiments there may be another number of flanges, such as one, two, three, five or even more flanges. It will also be appreciated that instead of guide flanges, the guide means 80 may instead be provided by a ledge (not shown) on one or both sides of the first diameter.

Figure 12:
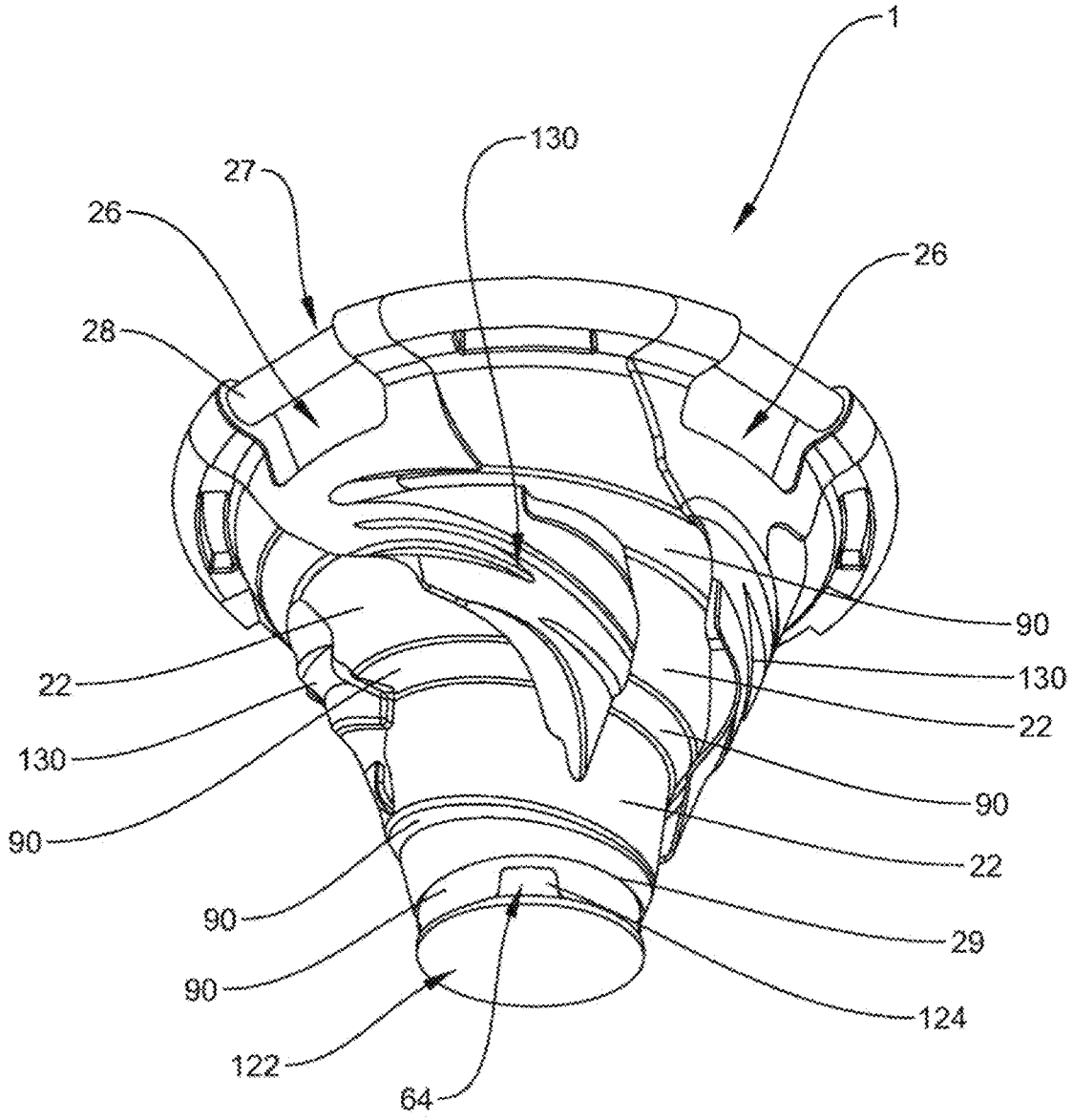
FIG. 12, in a perspective view, shows the toy spinning top of FIGS. 7-11 from below.

Turning now to FIG. 12, markings 130 may be provided on or in the sidewall 20 of the spinner body 10. The markings 130 may as shown be formed as irregular areas, spiralling on the outer surface 22 of the sidewall 20. The markings are slightly elevated from the outer surface 22 of the sidewall 20.

The elevated markings 130 may be formed on the outer surface 22 of the sidewall 20 or they may be formed integrally with the sidewall, e.g. in a plastic, for example in a moulding process, such as injection moulding.

The spinner body 10 may be formed in a see-through material, e.g. a material that is transparent or at least partly transparent (allow visual inspection of toy figurine).

However, in other embodiments, the spinner body 10 may be formed in non-transparent material.

In yet other embodiments the sidewall 20 as such is formed in a transparent material, whereas the areas forming the markings 130 are formed in a non-transparent material. When the toy spinning top 1 is rotated to spin this will enhance a whirl-wind like appearance of the toy spinning top 1.

It is to be noted that the figures and the above description have shown the example embodiments in a simple and schematic manner. Many of the specific mechanical details have not been shown since the person skilled in the art should be familiar with these details and they would just unnecessarily complicate this description. For example, the specific materials used and the specific injection moulding procedure have not been described in detail since it is maintained that the person skilled in the art would be able to find suitable materials and suitable processes to manufacture the container according to the current invention.

PARTS LIST

1 toy spinning top
10 spinner body
20 sidewall
21 top rim of side wall
22 outside surface of sidewall
23 inside surface of sidewall
24 lower internal rim of sidewall
25 internal space inside spinner body
26 cut-outs in sidewall
27 third connection means for connecting secondary toy building elements to the toy spinning top
28 cylindrical bars
29 external lower rim of sidewall
30 bottom wall
31 outside bottom surface of bottom wall
32 internal bottom surface of bottom wall
40 first connection means for releasably connecting the feet of toy figurine to the toy spinning top
41 knob/protrusion
42 knob/protrusion
50 toy figurine
51 head
52 body
53 shoulder portion
54 arms extending from said shoulder portion;
55 legs
56 feet

57 second connection means
58 indentations
59 hands
60 fifth connection means
61 recessed cylindrical flange
62 central cylindrical stud
63 ring shaped space between central cylindrical stud and central cylindrical stud
70 separator guard
71 plate/ridges
72 plate/ridges
80 guide means
81 guide flange
82 guide flange
83 guide flange
84 guide flange
90 spiralling ledge in outer surface of sidewall
95 spiralling ledge in inner surface of side wall
100 toy system
110 secondary toy building elements
111 fourth connection means on secondary toy building element
112 gripping claws
113 seventh connection means on secondary toy building element configured for coupling to tertiary toy building elements
115 tertiary toy building elements
120 bottom building element
121 sixth connection means on the bottom building element
122 bottom surface of bottom building element
123 surface of the bottom building element carrying the sixth connection means—opposite to the bottom surface of the bottom building element
124 knobs/protrusions
130 markings
A elongate axis of spinner body
h1 first height, height of sidewall from said inner bottom surface to said top rim
h2 second height; height of the toy figurine said feet to said shoulder portion

The invention claimed is:

1. A toy system comprising:
a toy spinning top; and
a toy figurine;
wherein said toy spinning top comprises a spinner body with an elongate axis (A); a sidewall; and a bottom wall;
wherein said sidewall of the spinner body comprises a top rim; an outside surface; and an inside surface;
wherein said bottom wall comprises an outside bottom surface; and an inside bottom surface;
wherein the inner bottom surface comprises a first connection means for releasably connecting a second connection means of said toy figurine to the toy spinning top, and allowing transfer of torque from said toy figurine to said toy spinning top;
wherein said sidewall has a height (h1) from said inner bottom surface to said top rim which extends over a major part of the height of said toy figurine; and
wherein said sidewall has a taper along said height (h1), the taper being narrower at said inner bottom surface and wider at said top rim.

2. A toy system according to claim 1, wherein the height (h1) from said inner bottom surface to said top rim is equal a height (h2) of the toy figurine from the second connection means formed at a bottom of the legs to a shoulder portion of a body formed between the legs and a head resting on said shoulder portion.

3. A toy system according to claim 1, wherein said body of the toy spinning top is frusto-conically shaped.

4. A toy system according to claim 1, wherein the sidewall forms an angle of 10-25° relative to said elongate axis (A).

5. A toy system according to claim 1, wherein at least a plurality of cut-outs are formed in the sidewall at the top rim, and where each cut-out is provided with third connection means for connecting to a secondary toy building elements.

6. A toy system according to claim 1, comprising a bottom building element having a rounded and smooth bottom surface, said bottom building element being connectable to fifth connection means formed at said outside bottom surface of the spinner body.

7. A toy system according to claim 1, wherein a separator guard is formed at the internal bottom surface.

8. A toy system according to claim 1, wherein a guide means are formed at an intersection between the internal bottom surface and the inside surface of said sidewall.

9. A toy system according to claim 1, wherein an outside spiraling ledge is formed in the outside surface of the spinner body, and wherein an inside spiraling ledge is formed in the inside surface of the spinner body.

10. A toy system according to claim 9, wherein said toy figurine comprises a body with a shoulder portion, legs extending from said body and at one end of which second connection means are formed; and a head on top of said shoulder portion, and wherein said toy figurine has a second height (h2) from said second connection means to said shoulder portion.

11. A toy spinning top for use in a toy system according to claim 1.

* * * * *